US005088641A

United States Patent [19]

Shepard

[11] Patent Number: 5,088,641

[45] Date of Patent: Feb. 18, 1992

[54] CONTAINER WITH INTERNAL DIVIDER

[75] Inventor: Gerald R. Shepard, Grand Rapids, Mich.

[73] Assignee: Rapid-Packaging Corporation, Grand Rapids, Mich.

[21] Appl. No.: 661,918

[22] Filed: Feb. 27, 1991

[51] Int. Cl.[5] ..... B65D 5/48

[52] U.S. Cl. ..... 229/120.17; 229/120.18

[58] Field of Search ..... 229/120.17, 120.18, 229/120.26, 120.29

[56] References Cited

U.S. PATENT DOCUMENTS

| | | | |
|---|---|---|---|
| 2,586,886 | 2/1952 | Tyrseck | 229/120.17 |
| 2,711,819 | 6/1955 | Vanderlugt, Jr. | 229/120.26 |
| 4,347,967 | 9/1982 | Loudermilk, Jr. | 229/120.17 |
| 4,418,818 | 12/1983 | Stone | 229/120.17 |
| 4,574,996 | 3/1986 | Brian | 229/120.17 |

FOREIGN PATENT DOCUMENTS

| | | | |
|---|---|---|---|
| 658435 | 2/1963 | Canada | 229/120.17 |
| 729474 | 3/1966 | Canada | 229/120.17 |
| 359083 | 10/1931 | United Kingdom | 229/120.17 |
| 745304 | 2/1956 | United Kingdom | 229/120.18 |

*Primary Examiner*—Gary E. Elkins
*Attorney, Agent, or Firm*—Price, Heneveld, Cooper, DeWitt & Litton

[57] ABSTRACT

The specification discloses a container including a pair of dividers for providing four cells. Divider slots are such that one divider cannot be caught on the bottom surface of the other divider when the container is folded from a flat position to an open position.

16 Claims, 6 Drawing Sheets

CONTAINER WITH INTERNAL DIVIDER

BACKGROUND OF THE INVENTION

The present invention relates to assembleable containers including dividers for providing cells therein, and more particularly, to such a container wherein the container dividers are assuredly positioned for full assembly upon unfolding of the container from a partially assembled shipping position.

A prior art assembleable container 10 is illustrated in FIG. 1 and includes (proceeding from left to right in the figure): a joining tab 11; a divider 12, including a slot 12*a* and bottom edges 12*b* and 12*c*; a joining tab 16; a back panel 17; a top panel 18; a top flap 19; a side panel 20; a side top flap 24; a bottom tab 25; a divider 26 including a slot 27 with a deepest point 28; a front panel 32; a bottom panel 33, including a bottom flap 34; a side panel 35; a side top flap 36; and a bottom side flap 37. Additionally, container 10 includes a plurality of scores which are formed in a well-known manner and allow the box to be easily assembled by folding the respective sections at the scores. Thus, to partially assemble container 10, tab 11 is affixed to side 20 and tab 16 is affixed to side 35 using an adhesive.

After tabs 11 and 16 are affixed to sides 20 and 35 respectively, container 10 is folded flat for shipment, as illustrated in FIG. 2. When the container is folded flat, divider 26 is folded on a score 52 and positioned within the interior of the container between divider 12 and front panel 32. To unfold container 10 from the folded flat shipping position, divider 26 is slid through slot 12*a* so that the container may move to the open position illustrated in FIGS. 3 and 4. Preferably, upon unfolding of the container, flap 26 will be positioned as illustrated in solid lines in FIG. 3, so that flap 25 and divider 26 may be moved up into the position 25B and 26B illustrated in dashed lines in FIG. 3, wherein divider 26 is received within slot 12*a* of divider 12, and divider 12 is received in slot 27 of divider 26. In this position, flap 25 will be positioned under bottom edge 12*b* of divider 12, bottom flap 37 can then be pushed up under the bottom edge 12*c* of divider 12. Flap 34 may then be received within the container between divider 26 and back 17 so that bottom 33 will cover bottom flaps 25 and 37.

However, when unfolded from the flat shipping position (FIG. 2) to the open position of FIGS. 3 and 4, divider 26 of container 10 is often positioned as illustrated by phantom flaps 25A and 26A in FIG. 3. This incorrect positioning of flap 25 and divider 26 is due to the bias in score 52 which pulls flap 25 and divider 26 toward the position they assume when folded flat. As illustrated in FIG. 4, incorrect positioning of divider 26 places apex 28 of slot 27 against edge 12*b* of divider 12. A machine for assembling the containers will thus push flap 25 and divider 26 upwardly and apex 28 of slot 27 will be driven into bottom edge 12*b* of divider 12, damaging both dividers 12 and 26, and destroying the container. Consequently, the cost of useful containers is increased due to the substantial number of containers which are destroyed during assembly. Alternatively, the cartons may be unfolded and fully assembled by hand. However, the person assembling the container must manually move divider 26 into slot 12*a* before pushing the dividers together, which increases manual assembly time.

SUMMARY OF THE INVENTION

The present invention is embodied in a container providing a construction in which the second divider will be automatically and assuredly positioned within the slot of the first divider when the container is opened from its partially assembled, folded flat, position. By providing the dividers such that they are correctly and positively positioned for automated assembly when opened from the folded flat position, the number of containers destroyed during automated assembly is significantly reduced. Additionally, the containers are easy to assemble by hand as the dividers are automatically positioned for full assembly when the containers are unfolded from the flat position. These and other objects, advantages and features of the invention will become apparent upon review of the following specification in connection with the drawings.

DESCRIPTION OF THE PREFERRED EMBODIMENT

Figure 1:
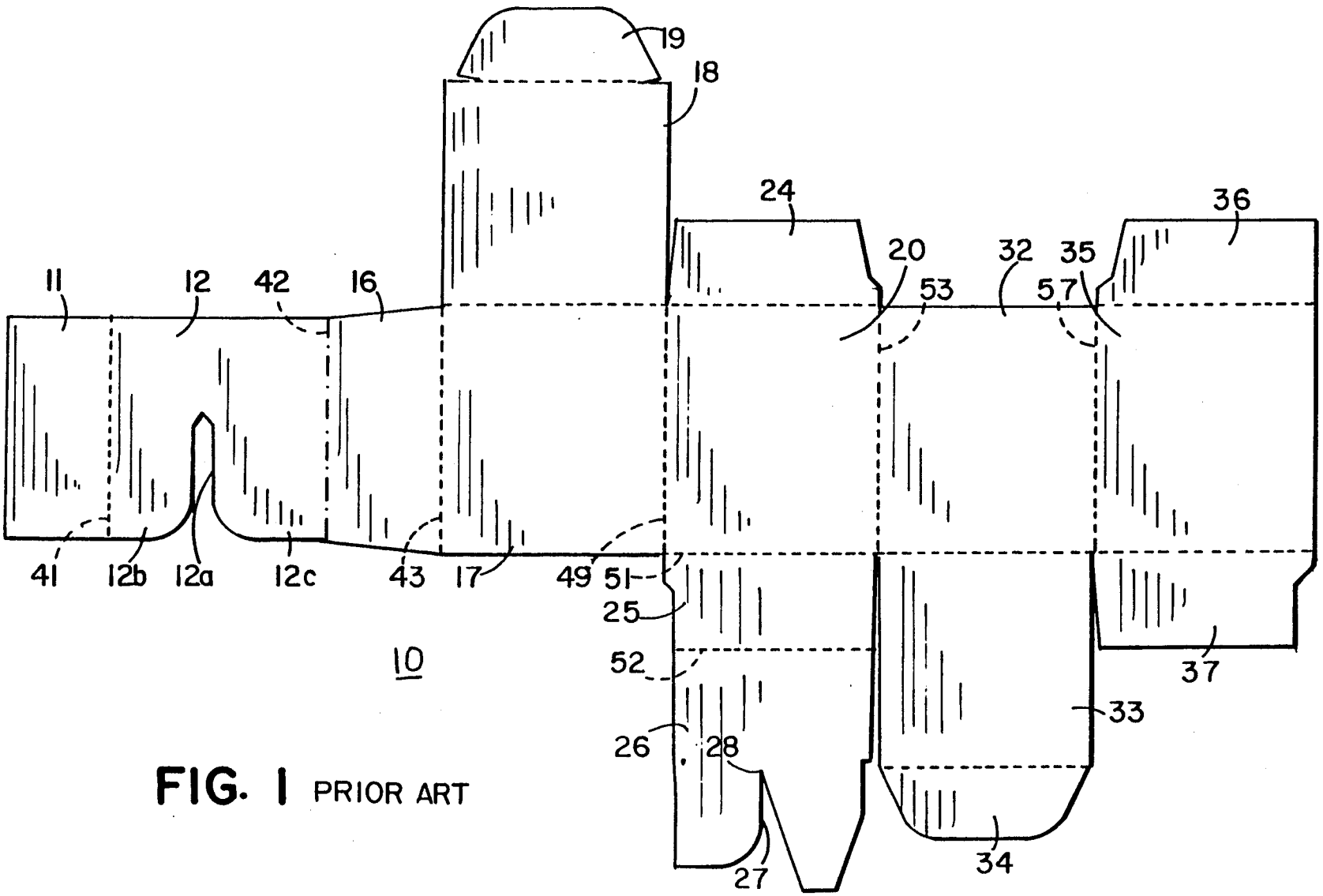
FIG. 1 PRIOR ART
FIG. 1 illustrates the prior art container cut and unassembled.
Figure 2:
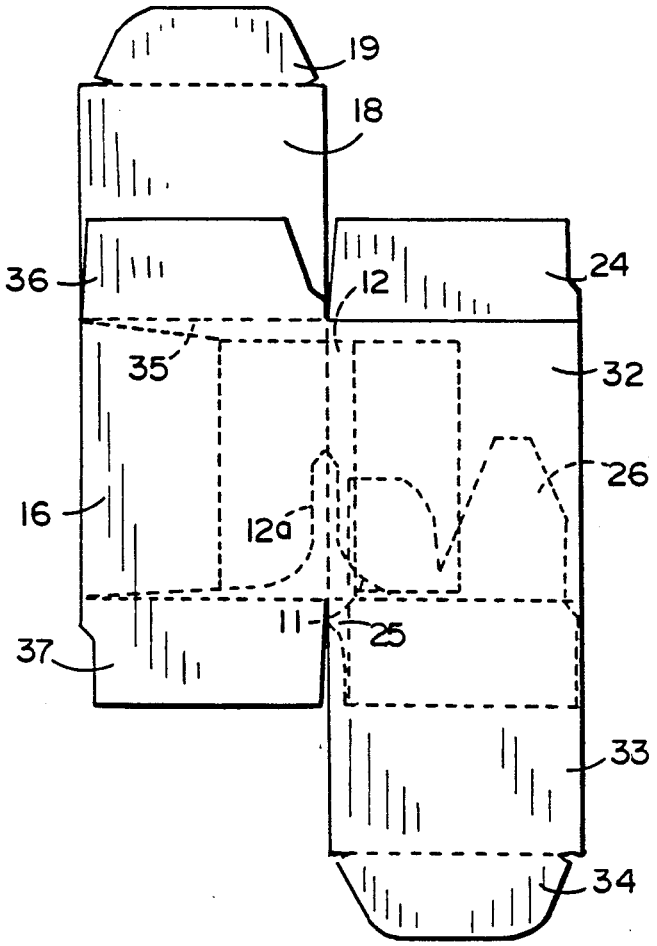
FIG. 2 PRIOR ART
FIG. 2 illustrates the prior art container partially assembled and folded flat.
Figure 3:
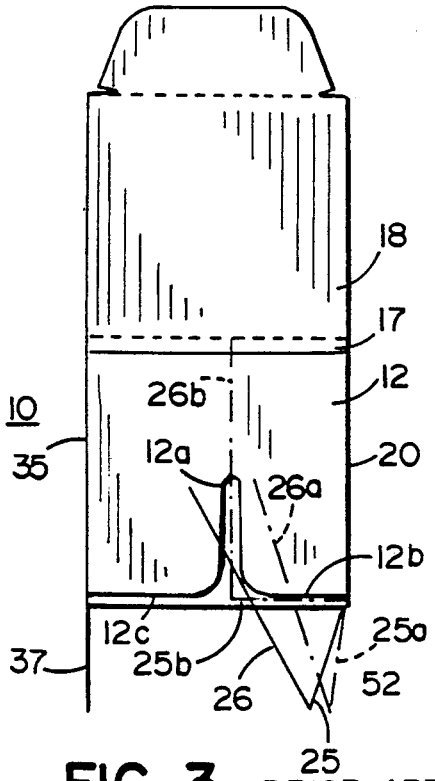
FIG. 3 PRIOR ART
FIG. 3 is a sectional view of the dividers of the prior art container.
Figure 4:
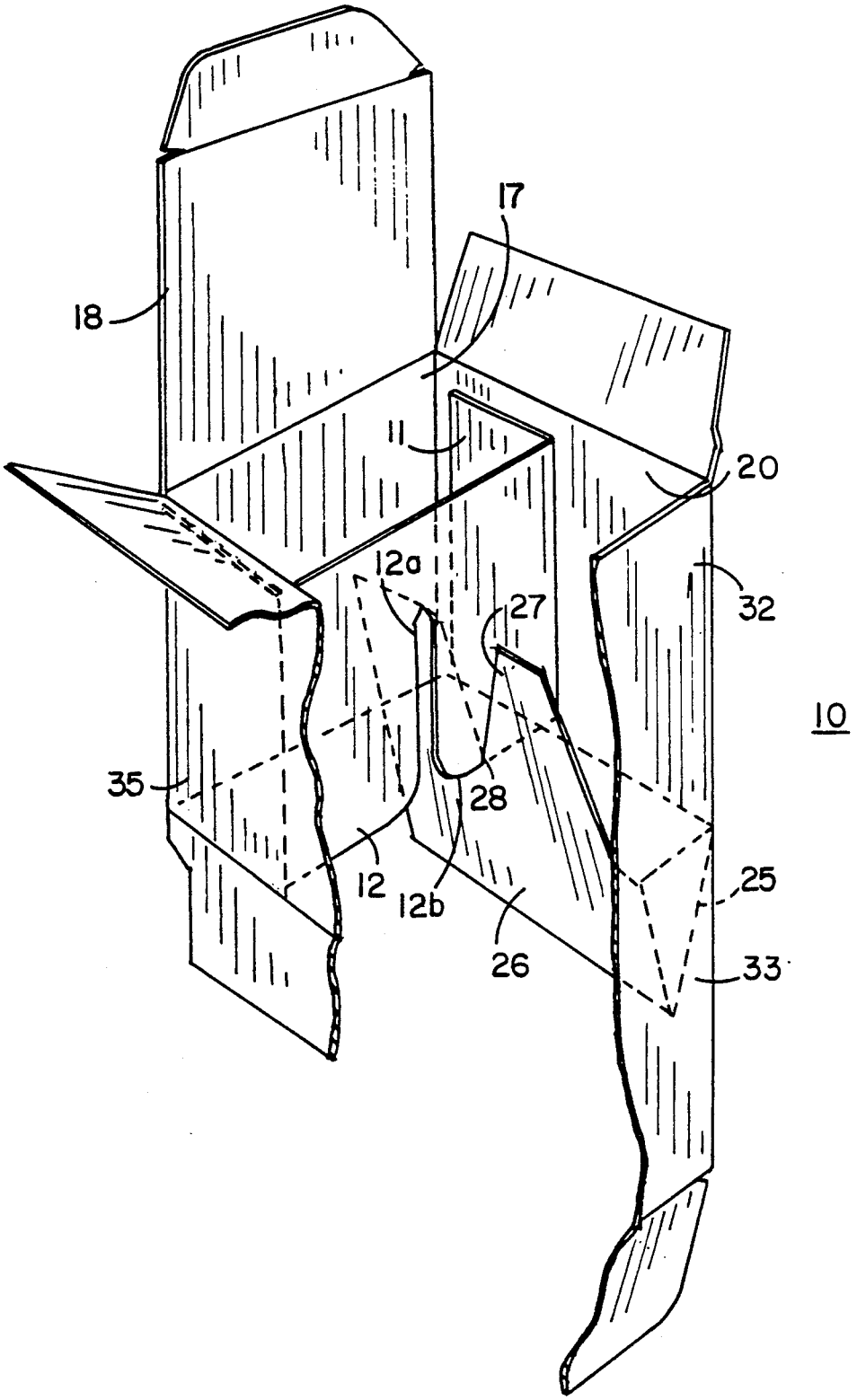
FIG. 4 PRIOR ART
FIG. 4 is a cutaway view of the interior of the prior art container unfolded with the second divider positioned under the bottom edge of the first divider.
Figure 5:
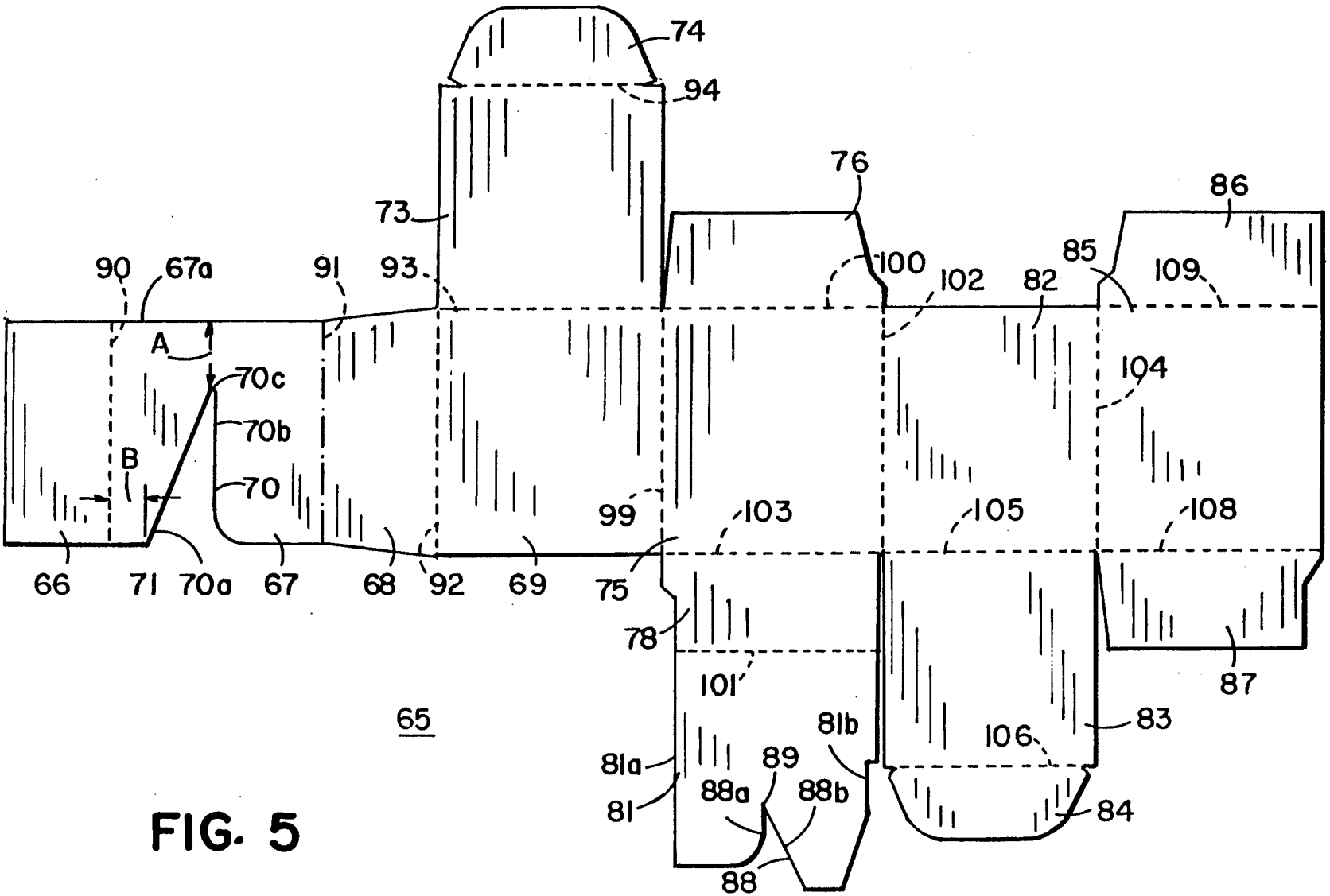
FIG. 5 shows the container of the invention cut and unassembled.

An assembleable container according to the invention is illustrated in FIG. 5, and includes: a back panel 69; a top panel 73; a side panel 75; a front panel 82; a bottom panel 83; and a side panel 85, which together form the outside envelope of the container. Additionally, the container includes a first divider 67 and a second divider 81 which divide the inside of the container into cells wherein respective parts may be positioned. The container also includes joining tabs 66 and 68; a bottom tab 78; a top flap 74; a bottom flap 84; and side flaps 76, 86 and 87, which interconnect the panels and dividers, and hold parts within the container. Joining tabs 66 and 68 space divider 67 from back panel 69, and provide a surface upon which adhesive may be placed to assemble the carton. Bottom tab 78 spaces divider 81 from side panel 75, and provides a surface on which parts are placed in the container.

Scores are formed in the container to ease the assembly thereof. Thus, the container further includes: a score 90 between joining tab 66 and divider 67; a score 91 between divider 67 and joining tab 68; a score 92 between joining tab 68 and back panel 69; a score 93 between back panel 69 and top panel 73; a score 94 between top panel 73 and flap 74; a score 99 between back panel 69 and side panel 75; a score 100 between side panel 75 and top flap 76; a score 101 between bottom flap 78 and divider 81; a score 102 between side panel 75 and front panel 82; a score 103 between side panel 75 and bottom flap 78; a score 104 between front 82 and side panel 85; a score 105 between front panel 82 and bottom panel 83; a score 1 06 between bottom panel 83 and flap 84; a score 108 between side panel 85 and flap 87; and a score 109 between side panel 85 and top flap 86. These scores insure that the container folds properly and reduce the force required to fold the container sections.

As illustrated in FIG. 5, dividers 67 and 81 include slots 70 and 88, respectively. Slot 70 includes an edge 70*b*, which is illustrated as being generally parallel to scores 90 and 91 although edge 70*b* could be angled relative to scores 90 and 91, a substantially straight, angled, edge 70*a* and an apex 70*c*. Slot 88 includes a first edge 88*a* which is generally parallel to edges 81*a* and 81*b* of divider 81, a second edge 88*b* which is angled with respect to edge 88*a*, and an apex 89. The distance A between apex 70*c* of slot 70 and top edge 67*a* of divider 67 is limited by two considerations. First, slot 70 must be deep enough to receive the length of divider 81 between apex 89 of slot 88 and score 101. Second, distance A must be large enough for divider 67 to be rigid throughout its length. Thus, distance A will depend upon the material from which container 65 is manufactured, and the dimensions of divider 67.

To partially assemble container 65, joining tabs 66 and 68 are affixed to side panels 75 and 85, respectively, using an adhesive. The container is then folded flat in the position illustrated in FIG. 6. In this position, a large number of containers may be stored in a relatively small volume and economically shipped.

Figure 6:
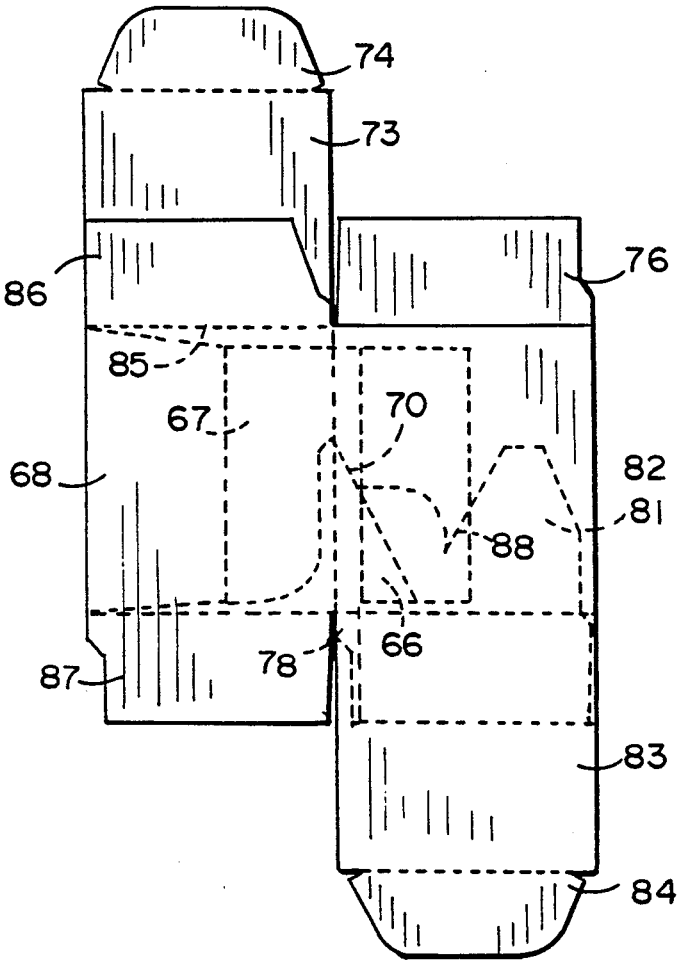
FIG. 6 illustrates the container of the invention partially assembled and folded flat.

When the container is folded flat for shipment, as illustrated in FIG. 6, side panel 85, front panel 82, flap 6, flap 87 and flap 84 will have their exterior container surface exposed and facing upwardly. Additionally, a portion of top panel 73, flap 74 and flap 76 will have their interior container surface exposed and facing upwardly. In the interior of the container, a portion of divider 81 will be positioned between front panel 82 and divider 67. A portion of divider 67 and tab 66 will in turn be positioned between divider 81 and side panel 75. Tab 68 will be positioned between side 85 and back panel 69. Another portion of divider 67 is positioned between side panel 85 and back panel 69.

Figure 7:
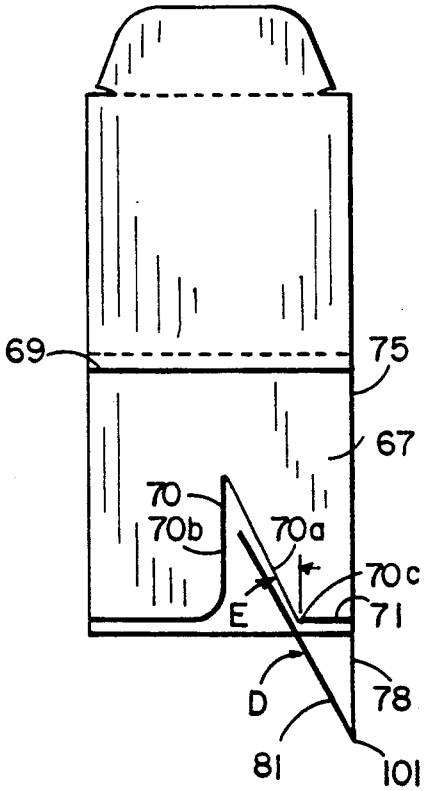
FIG. 7 is a sectional view of the dividers of the container of the invention.
Figure 8:
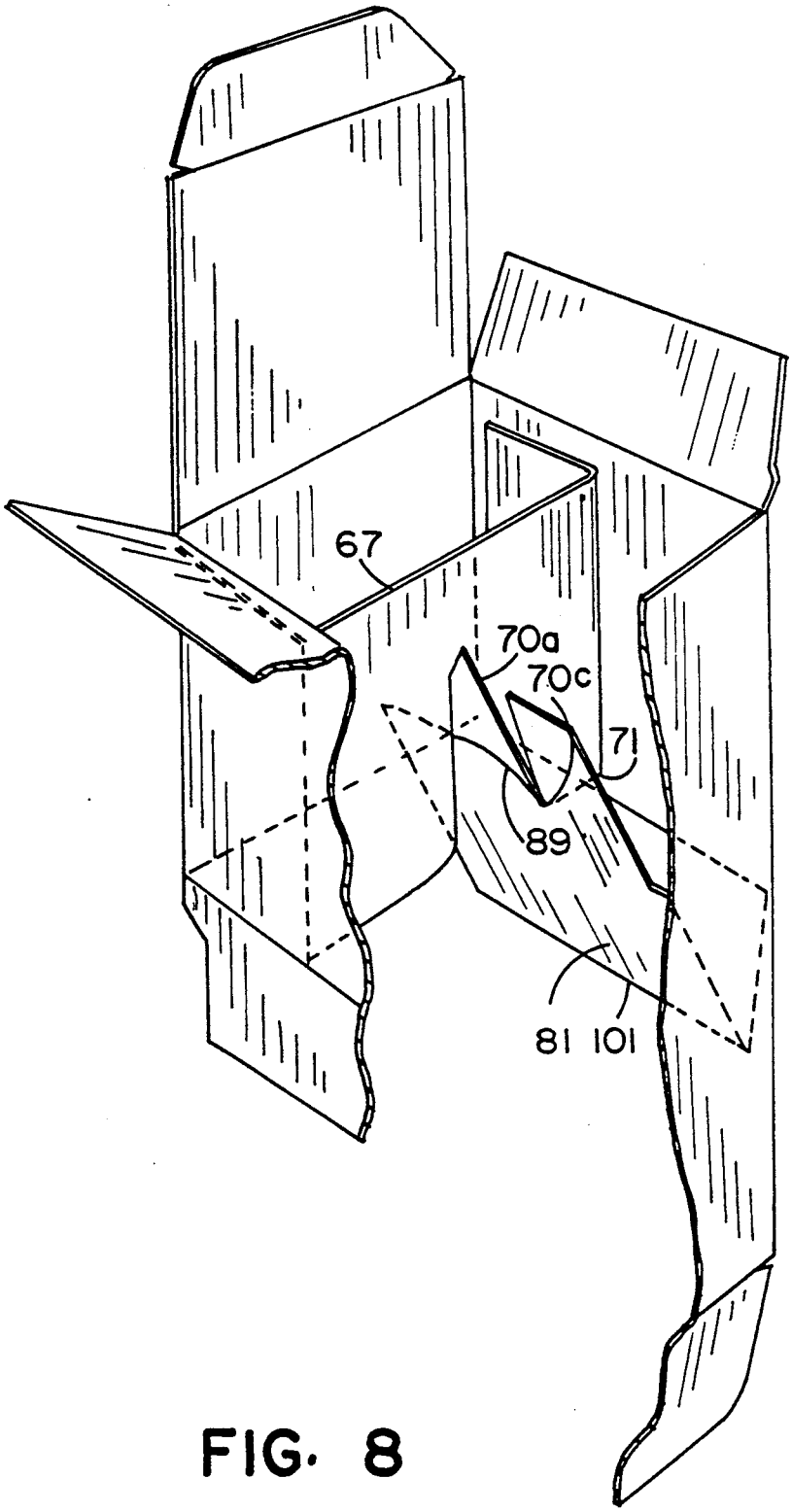
FIG. 8 is a cutaway view of the interior of the container showing the position of the first and second dividers when the container is initially unfolded.

As container 65 is unfolded from the flat position illustrated in FIG. 6 to the open position illustrated in FIGS. 7 and 8, divider 81 slides through slot 70 into divider 67 and edge 70*a* of slot 70 pushes divider 81 into slot 70. Divider 81 will thus be positioned as illustrated in FIG. 7 for insertion into slot 70. The depth of slot 88 is such that when flap 78 is coplanar with side 75, divider 81 cannot be moved beyond edge 70*a* of slot 70, and thus apex 89 (FIG. 8) cannot move into a position in contact with or beneath edge 71 of divider 67. Thus, slot 70 of divider 67 and slot 88 of divider 81 assist in assuredly positioning the dividers for assembly and prevent apex 89 of slot 88 from being positioned against the bottom edge 71 of divider 67.

The length and position of slot 70 in divider 67 is determined by several additional considerations. The length of side 71 is limited by the size of parts to be placed in the container. Thus, if small parts are to be placed in the container, side 71 must be long enough to prevent the parts from passing through slot 70 between edge 70*a* and divider 81. Additionally, the length of side 71 effects the length of slot 88 such that slot 88 must be of a length to prevent apex 89 from being positioned against or under edge 71. Additionally, the angle of edge 70*a* relative to score 90, and a plane parallel to side panel 75 intersecting when divider 67 and side panel 75 are orthogonal to one another, is preferably between 10° and 30°, and is most preferably between 15°–25°. The angle between edge 70*a* and side panel 75 may advantageously be equal to the angle between joining tab 78 and divider 81 when divider 81 is positioned against edge 70*a*, as illustrated in FIG. 7. However, the slope of edge 70*a* will be limited by the length of edge 71, as discussed above.

To fully assemble the container, divider 81 is pushed up into slot 70 such that slot 88 receives divider 67. Joining tab 78 will thus be positioned below edge 71. Tab 87 is then folded on score 108 and moved to a position below divider 67 and bottom panel 83 is folded on score 105 to a position adjacent bottom tabs 78 and 87. Flap 84 is inserted between tabs 78 and 87 and back panel 69 such that bottom panel 83 covers these tabs, and parts placed within container 65 will be secured therein.

To close the container, tabs 76 and 86 are folded on scores 100 and 109, respectively, such that they are positioned above edge 67*a* of divider 67. Top panel 73 is then folded on score 93 and positioned to cover tabs 76 and 86, with flap 74 inserted between tabs 76 and 86 and front panel 82. The container thus forms a self contained enclosure having four interior cells wherein parts may be held.

Although the above description is directed to a container having four cells, a container having six cells may be provided using an additional divider (not shown) extending from tab 87 (FIG. 5) just as divider 81 projects from tab 78. Said additional divider would be a mirror image of divider 81 in FIG. 5. An additional slot (not shown), which would be a mirror image of slot 70, would be provided in divider 67 in spaced relation to slot 70 for receiving the additional divider. Thus, when the six cell carton is assembled, the additional divider would be received in the additional slot and it would be oriented generally parallel to divider 81 when divider 81 is received in slot 70.

It can thus be seen that an assembleable container is illustrated which includes dividers for forming cells therein and avoids the problem of the prior art wherein containers were destroyed when the dividers were improperly positioned for assembly. The above description is considered that of the preferred embodiment only, and modifications of the invention will occur to those who make or use the invention. For example, although the container illustrated is for right-to-left opening, the container may be made for left-to-right opening by forming the container inside-out from the illustrated container in the same manner as described with respect to the right-to-left container (i.e., joining tab 66 affixed to side panel 75 and joining tab 68 affixed to side panel 85). Therefore, it is understood that the embodiments shown in the drawings and described above are merely for illustrative purposes and is not intended to limit the scope of the invention, which is defined by the following claims as interpreted according the principles of patent law.

The embodiments of the invention in which an exclusive property or privilege is claimed are defined as follows.

1. An assembleable container having cells therein when fully assembled, said container moveable between a folded flat position and an open position, comprising:

a back panel and an adjacent first side panel having spaced side edges, a top edge and a bottom edge;

a first divider having top, bottom and side edges, one of said side edges of said divider abutting said first side panel intermediate the edges of said first side panel;

a first joining tab attached to and extending from said back panel and joining said first divider at a point spaced from said first side, whereby said first divider and said first joining tab are folded flat against said back panel and said first side panel in said folded flat position, and said first divider and said first joining tab can also be folded into a position in which said first divider projects from said first side panel and is spaced from said back panel by folding said back panel to an angle of less than 180° with respect to said first side panel in said open position, said first divider dividing the volume of said container when said container is in said open position and including a first slot extending upwardly from said bottom edge thereof, said first slot being wider at side bottom edge and narrowing to an apex located intermediate said top and bottom edge of said first divider;

a second divider attached to a bottom tab which in turn is attached to said bottom edge of said first side;

said second divider adapted to be folded up into engagement with and oriented at an angle of less than 180° with respect to said first divider when said container is fully assembled;

said second divider including a second slot which is open at an edge of said second divider which is spaced from said bottom tab, said second slot narrowing to an apex at a point intermediate said spaced edge and said bottom tab, and said second divider being folded flat against said first side panel and said first divider in said folded flat position; and said first slot in said first divider including a first edge and a second edge, said first edge closer to said first side panel than said second edge, and said first edge extending substantially from said bottom edge of said first divider to said apex of said first slot at an angle between 10° and 30° with respect to a plane which intersects said edge, said plane parallel to said first side panel when said first divider is in said open position, whereby when said container is opened from said folded flat position to said open position, said second divider tends to move along said first divider into position within said first slot, and when said second divider is positioned within said first slot during the opening of the container, said first edge pushes said second divider into said first slot, and said first edge of said first slot not interfering with the movement of the second divider within said first slot.

2. The container as defined in claim 1, wherein said first edge of said first divider is at an angle of between 15° and 25° with respect to said plane which is parallel to said first side panel when said divider projects orthogonally from said first side panel.

3. The container as defined in claim 1, further including a front panel adjacent said first side panel, a second side panel adjacent said front panel and said back panel, a top panel, and a bottom panel.

4. The container as defined in claim 3, further including a tab extending from said first divider, wherein said first joining tab is affixed to said second side panel, and said tab extending from said first divider is affixed to said first side panel.

5. The container as defined in claim 1, wherein said first slot is substantially longer than said second slot and wherein said slots in said dividers position the dividers generally orthogonal to one another when the second divider is fully received in said first slot and said first divider is fully received in said second slot.

6. The container as defined in claim 1 wherein said apex of said second slot is positioned in said second divider at a location which prevents the second divider from moving out of said first slot toward said bottom tab when said container is unfolded from said folded flat position to said open position.

7. An assembleable container having cells therein when fully assembled, comprising:

a back panel and an adjacent first side panel having spaced side edges, a top edge and a bottom edge;

a first divider having top, bottom and side edges, one of said side edges of said divider abutting said first side panel intermediate the edges of said first side panel;

a first joining tab attached to and extending from said back panel and joining said first divider at a point spaced from said first side, whereby said first divider and said first joining tab can be folded flat against said back panel and said first side panel, and can also be folded into an open position in which said first divider projects from said first side panel and is spaced from said back panel by folding said back panel to an angle of less than 180° with respect to said first side panel, said first divider for dividing the volume of said container and including a first slot extending upwardly from said bottom edge thereof, said first slot being wider at said bottom edge and narrowing to an apex located intermediate said top and bottom edge of said first divider;

a second divider attached to a bottom tab which in turn is attached to said bottom edge of said first side;

said second divider adapted to be folded up into engagement with and oriented at an angle of less than 180° with respect to said first divider when said container is fully assembled;

said second divider including a second slot which is open at the edge of said second divider which is spaced from said bottom tab and which narrows to an apex at a point intermediate said spaced edge and said bottom tab; and said first slot in said first divider including a first edge and a second edge, said first edge closer to said first side panel than said second edge, and said first edge extending substantially from said bottom edge of said first divider to said apex of said first slot at an angle between 10° and 30° with respect to said first side panel when said first divider is in said open position, whereby said slot will receive said second divider without interfering with the movement of the second divider within said first slot;

wherein said angle between said first edge of said first slot and said first side panel is substantially the same as an angle between said second divider and said first side panel when said first panel is in the same plane as said bottom tab, said first divider is orthogonal to said first side panel, and a portion of said second divider is positioned adjacent said first edge.

8. The container as defined in claim 7, wherein said second edge of said first slot is generally orthogonal to a bottom edge of said first divider, and the angle between the first edge of said first slot and the bottom edge of said first divider is between 60° and 80°.

9. An assembleable container having cells therein when fully assembled, comprising:

a back panel and an adjacent first side panel having spaced side edges, a top edge and a bottom edge;

a first divider having spaced top, bottom and side edges, one of said side edges of said first divider abutting said first side panel intermediate said side edges of said first side panel;

a first joining tab attached to and extending from said back panel and joining said first divider at a point spaced from said first side, whereby said first divider and said first joining tab can be folded flat against said back panel and said first side panel, and can also be folded into an open position in which said first divider projects from said first side panel and is spaced from said back panel by folding said back panel to an angle of less than 180° with respect to said first side panel, said first divider for dividing the volume of said container and including a first slot extending upwardly from a bottom edge thereof, said first slot being wider at said bottom edge and narrowing to an apex located intermediate the top and bottom edge of said first divider flap;

a second divider attached to a bottom tab which in turn is attached to said bottom edge of said first side;

said second driver adapted to be folded up into engagement with and oriented at an angle of less than 180° with respect to said first divider when said container is fully assembled;

said second divider including a second slot which is open at an edge of said second divider which is spaced from said bottom tab, said second slot narrowing to an apex at a point intermediate said spaced edge and said bottom tab; and said first and second slots being formed such that said second slot apex cannot be positioned against said bottom edge of said first divider, and is thus positioned in said first slot, when said second divider is folded up into said first slot and said bottom tab is in the plane of said first side panel whereby said second divider slides up into said first slot when said bottom tab is folded up toward said first divider to an angle of less than 180° with respect to said first side panel and does not jam up against said bottom edge of said first divider.

10. The container as defined in claim 9, wherein said first slot in said first divider comprises a first edge and a second edge, said first edge closer to said first side panel than said second edge when said container is in said open position, said first edge of said first slot being generally straight and extending substantially from the bottom edge of said first divider to said apex of said first slot, said first edge of said slot being at an angle of greater than 10° and less than 30° with respect to a reference plane which is parallel to said first side panel when said first divider is in said open position and said reference plane intersects said first edge.

11. The container as defined in claim 10, wherein said first edge of said first divider is at an angle of between 15° and 25° with respect to a plane which is parallel to said first side panel, when said divider projects orthogonally from said first side panel, and said plane intersects said first edge of said slot.

12. The container as defined in claim 9, further including a front panel adjacent said first side panel, a second side panel adjacent said front panel and said back panel, and bottom and top panels, said bottom, top, side, and back panels all being generally orthogonal to one another when said container is fully assembled.

13. A container as defined in claim 12, further including a tab extending from said first divider, wherein said first joining tab is affixed to said second side panel, and said tab extending from said first divider is affixed to said first side panel.

14. A container as defined in claim 10, wherein said first slot is substantially longer than said second slot and wherein said slots in said dividers position the dividers generally orthogonal to one another when the second divider is fully received in said first slot and said first divider is fully received in said second slot.

15. The container as defined in claim 10, wherein said angle between said first edge of said first slot and said first side panel is substantially the same as an angle between said second divider and said first side panel when said bottom tab and said first side panel are in the same plane, said first divider is orthogonal to said first side panel and a portion of said second divider is positioned adjacent said first edge.

16. The container as defined in claim 15, wherein said second edge of said first slot is generally orthogonal to a bottom edge of said first divider, and the angle between the first edge of said first slot and the bottom edge of said first divider is between 60° and 80°.

* * * * *

UNITED STATES PATENT AND TRADEMARK OFFICE

CERTIFICATE OF CORRECTION

PATENT NO. : 5,088,641

DATED : February 18, 1992

INVENTOR(S) : Gerald R. Shepard

It is certified that error appears in the above-identified patent and that said Letters Patent is hereby corrected as shown below:

Column 3, Line 5:

"score 1 06" should be --score 106--

Column 3, Lines 35 and 36:

"flap 6" should be --flap 86--

Column 7, Claim 9, Line 36:

"driver" should be --divider--

Signed and Sealed this

Seventh Day of September, 1993

Bruce Lehman

*Attest:*

BRUCE LEHMAN

*Attesting Officer*

*Commissioner of Patents and Trademarks*